United States Patent [19]

Owen et al.

[11] 4,066,531

[45] Jan. 3, 1978

[54] PROCESSING HEAVY REFORMATE FEEDSTOCK

[75] Inventors: Hartley Owen, Belle Mead; Paul B. Venuto, Cherry Hill; Edward J. Rosinski, Pedricktown, all of N.J.

[73] Assignee: Mobil Oil Corporation, New York, N.Y.

[21] Appl. No.: 616,964

[22] Filed: Sept. 26, 1975

[51] Int. Cl.[2] ..... C10G 11/02

[52] U.S. Cl. ..... 208/120

[58] Field of Search ..... 208/120, 62, 66

[56] References Cited

U.S. PATENT DOCUMENTS

| | | | |
|---|---|---|---|
| 3,247,098 | 4/1966 | Kimberlin | 208/120 |
| 3,395,094 | 7/1968 | Weisz | 208/62 |
| 3,719,586 | 3/1973 | Benner | 208/66 |
| 3,753,891 | 8/1973 | Graven et al. | 208/62 |
| 3,761,394 | 9/1973 | Reynolds et al. | 208/120 |
| 3,791,962 | 2/1974 | Demmel et al. | 208/120 |
| 3,849,290 | 11/1974 | Wise et al. | 208/66 |
| 3,928,174 | 12/1975 | Bonacci et al. | 208/120 |
| 3,928,175 | 12/1975 | Owen | 208/120 |

*Primary Examiner*—Delbert E. Gantz
*Assistant Examiner*—James W. Hellwege
*Attorney, Agent, or Firm*—Charles A. Huggett; Dennis P. Santini

[57] ABSTRACT

Liquid product rich in benzene, toluene and xylene and having a substantially lower mid-boiling point than heavy reformate feedstock or similar feedstock, such as, for example, from pyrolysis gasoline, of a class having an initial boiling point between about 230° F and about 250° F and an end point between about 350° F and about 430° F, and gaseous product rich in light olefins and isoparaffins which is good alkylation plant feed are produced by contacting said heavy reformate feedstock or said similar feedstock with a porous acid-active zeolite catalyst having a fluid activity index of at least about 18 in a fluidized catalyst system absent added hydrogen at a temperature of from about 800° F to about 1200° F, a catalyst/oil (i.e. heavy reformate or similar feedstock) weight ratio of from about 0.5 to about 40 and a catalyst residence time of from about 0.1 second to about 20 seconds.

8 Claims, 1 Drawing Figure

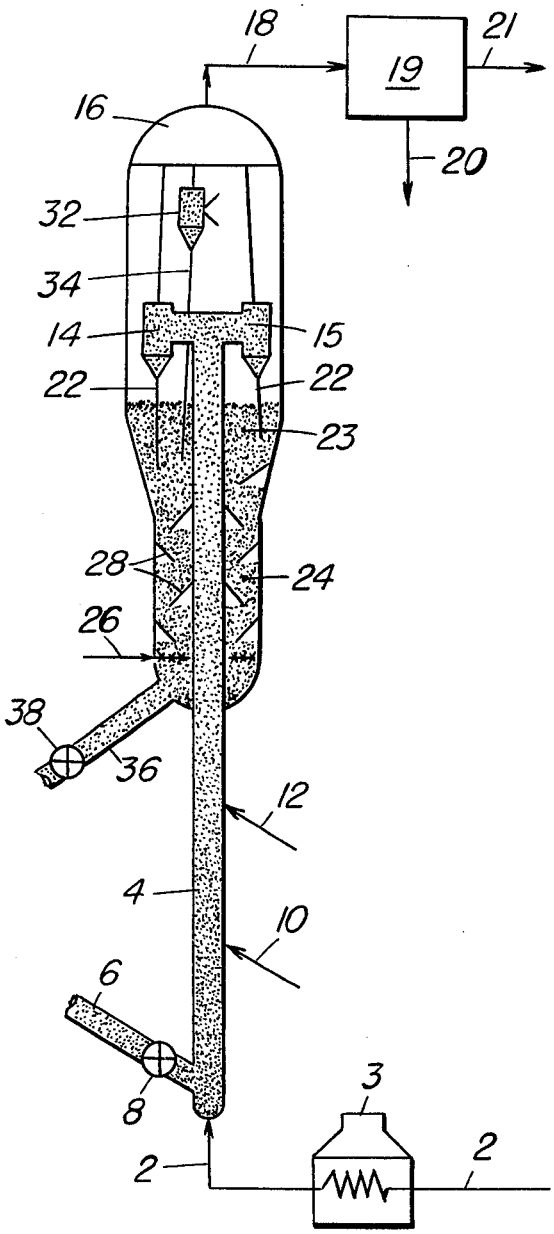
18
21
19
16
20
32
34
14
15
22
22
23
28
24
26
38
36
12
4
10
6
8
3
2
2

PROCESSING HEAVY REFORMATE FEEDSTOCK

BACKGROUND OF THE INVENTION

Of the aromatic compounds used in industry, benzene, toluene and xylenes are of outstanding importance on a volume basis. That mix of compounds, often designated BTX for convenience, is derived primarily from such aromatic naphthas as petroleum reformates and pyrolysis gasolines. The former result from processing petroleum naphthas over a catalyst such as platinum on alumina at temperatures which favor dehydrogenation of naphthenes. Pyrolysis gasolines are liquid products resulting from mild hydrogenation (to convert diolefins to olefins without hydrogenation of aromatic rings) of the naphtha fraction from steam cracking of hydrocarbons to manufacture ethylene, propylene, etc.

Regardless of aromatic naphtha source, it is usual practice to extract the liquid hydrocarbon with a solvent highly selective for aromatics to obtain an aromatic mixture of the benzene and alkylated benzenes present in the aromatic naphtha. That aromatic extract may then be distilled to separate benzene, toluene and $C_8$ aromatics from higher boiling compounds in the extract. The benzene and toluene are recovered in high purity but the $C_8$ fraction, containing valuable paraxylene, is a mixture of the three xylene isomers with ethylbenzene. Techniques are known for separating p-xylene by fractional crystallization with isomerization of the other two isomers for recycle in a loop to the p-xylene separation. That operation is hampered by the presence of ethylbenzene.

Concentrated aromatic fractions are also provided by severe cracking over such catalysts as ZSM-5 (U.S. Pat. Nos. 3,756,942 and 3,760,024) and by conversion of methanol over ZSM-5.

Methods available in the art for making alkylation products of aromatic hydrocarbon compounds include the liquid-phase alkylation of aromatics by contact with an alkylating agent in the presence of a crystalline aluminosilicate zeolite which contains various cations including rare earth cations (U.S. Pat. No. 3,251,897). Also, U.S. Pat. Nos. 3,751,504 and 3,751,506 show vapor-phase alkylation of aromatic hydrocarbon compounds by contact of the aromatic hydrocarbon compound with an alkylating agent in the presence of zeolite ZSM-5.

SUMMARY OF THE PRESENT INVENTION

It has now been discovered that processing of heavy reformate and similar feedstocks, i.e. those from which benzene and lighter components have been removed by distillation or the like and having an initial boiling point between about 230° F and about 250° F and an end point between about 350° F and about 430° F, in the absence of added hydrogen over catalysts comprised of porous acid-active zeolites having a fluid activity index of at least about 18, results in conversion products comprising:

a. liquid product rich in benzene, toluene and xylene chemicals, i.e. BTX, and having a substantially lower mid-boiling point than the heavy reformate feedstock, and b. gaseous product rich in light olefins and isoparaffins which is useful for alkylation plant feed or as a chemical feed stock.

Non-limiting examples of said porous acid-active zeolites having a fluid activity index, hereinafter FAI, of at least about 18 which are useful as the catalyst for the present process include the following:

1. rare earth exchanged zeolite Y,
2. rare earth exchanged zeolite X,
3. rare earth exchanged zeolite Y combined with mordenite,
4. dealuminized mordenite,
5. hydrogen exchanged zeolite ZSM-5,
6. hydrogen exchanged zeolite ZSM-35,
7. hydrogen exchanged zeolite ZSM-38,
8. rare earth exchanged zeolite ZSM-5, and others.

The process of this invention is conducted in a fluidized catalyst system, preferably in a riser/transport system or dilute phase bed, with the reactor system or riser inlet temperature maintained at between about 800° F and about 1200° F, the reaction pressure maintained at between about 2 psig and about 100 psig, a catalyst/oil weight ratio maintained at between about 0.5 and about 40, a catalyst residence time maintained at between about 0.1 second and about 20 seconds, a heavy reformate feedstock residence time maintained at between about 0.1 second and about 20 seconds and a slip ratio, defined as the ratio of catalyst residence time to heavy reformate feedstock residence time, maintained at between about 1 and about 2.

In constrast to a fixed bed type of aromatics upgrading process, the present process allows for continuous throughput at commercially acceptable rates without loss of down time due to the need for periodic, often complicated and sensitive regeneration procedures. This is possible because of the continuous regeneration aspect of the gas-solids fluid or dilute phase process. Another beneficial consequence of continuous regeneration is that the feed molecules are presented with a clean, uncoked catalyst surface, which utilizes the maximum catalyst selectivity potential of the acidic solid. Another favorable aspect is that the present process can employ, if desired, present commercially available, thermally stable, regenerable, proved FCC cracking catalysts. Another favorable aspect is that no expensive hydrogen gas is needed in the present process.

A particular advantage of this process concept is that it operates at low pressures (i.e. at pressure commonly employed in current fluid catalytic cracking operations or slightly higher). It allows highly efficient contact of gaseous reactant with solid, high surface area acidic catalysts, with efficient mixing, uniform temperature, and rapid separation and reaction quenching. Problems due to diffusion/mass transport limitations and/or heat transfer are minimized. While this process is preferred in riser or dilute phase beds, it is also applicable in fluidized dense beds. Single or multi-stage operations can be utilized. It is particularly suited for varying conversion severity and/or product selectivity in a highly flexible manner, since catalyst and hydrocarbon residence times, catalyst/oil ratio, temperature, and catalyst activity and type can be rapidly and smoothly varied within a short time if so desired. Further, catalyst or feedstocks can be varied rapidly and, if desired, run in blocked out operation.

A highly flexible petrochemical processing operation built around this fluid cat cracking-type technology could develop. Such petrochemical complex could logically be interlocked with existing refinery/chemical operations.

The invention is here described in detail as a means of processing heavy reformate from which benzene and lighter components have been removed. It will be immediately apparent that source of the heavy reformate feedstock is immaterial and that the detailed description herein concerns the preferred charge (because presently available in quantity). Other feedstocks of similar composition from pyrolysis gasoline, processing of aliphatics or methanol over ZSM-5 and the like can be processed in the same fashion.

The heavy reformate feedstock for the preferred embodiment of producing BTX (while making gasoline having good front end volatility, high octane number and low heavy end content) is here designated "$C_8$+ reformate". As is well known in the petroleum refining art, this does not normally define a fraction free of lighter material. Petroleum refinery fractionation is relatively imprecise, being designed to produce distillate and bottom cuts of desired boiling range. The present invention is intended for use in conventional equipment of petroleum refineries and therefore contemplates "sloppy" fractionation. The term "$C_8$+ reformate" as used herein means a fraction which contains most of the $C_8$ aromatics in the reformate and substantially all of the heavier aromatics present in the reformate. In general, the $C_8$+ reformate will contain 20% by weight or less of xylenes.

It is a characteristic feature of catalytic reforming that the heavy end contemplated for use in this invention is very low in aliphatic components. A very high proportion of the alkyl carbon atom content is constituted by alkyl substituents on aromatic rings. To a major extent, those side chains have been reduced to methyl groups. A moderate amount of ethyl groups are present and a few propyl and butyl groups are also seen in a typical heavy reformate. Longer alkyl chains are so minor that they can be disregarded. A principal reaction in reforming appears to be rearrangement and removal of methyl groups and removal of those few higher alkyl side chains present in the charge.

It is noted that in the process of the present invention the yield of aliphatics boiling in the BTX range is very small. In fact, substantial reduction in feed non-aromatics occurs, particularly at higher temperatures, thus providing high purity aromatic products.

It will be seen that the invention provides a new approach to manufacture of aromatic chemicals. It will probably find most advantageous application in plants of design different from those common at the present time.

DESCRIPTION OF THE DRAWING

The drawing depicts a typical fluidized catalyst system, e.g. a riser/transport system, for use in the present process whereby a heavy reformate or similar feedstock from which benzene and lighter components have been removed by distillation or the like and having an initial boiling point between about 230° F and about 250° F and an end point between about 350° F and about 430° F may advantageously be converted to liquid product rich in BTX and gaseous product rich in light olefins and isoparaffins.

As shown in the drawing, a heavy reformate or similar feedstock as described herein is fed via line 2 through feed preheater 3 into the inlet of riser 4 for admixture with hot catalyst introduced via standpipe 6 provided with flow control valve 8. The catalyst may be hot, regenerated catalyst from a regenerator or catalyst cascaded from a previous chemical or hydrocarbon conversion reaction, such as, for example, from a fluid catalytic cracking process. The mixture of catalyst and heavy reformate feedstock travels up the riser 4, within which reaction takes place under reaction conditions described herein. Residence time within the herein described limits is controlled by retaining the suspension initially formed in the riser 4 during flow therethrough. Additional heavy reformate feedstock may be introduced to riser 4 at one or more spaced apart downstream feed injection points 10 and 12 for residence times less then that employed for the feed introduced by line 2 but within the residence time limits herein described.

The hydrocarbon vapor-catalyst suspension passed upwardly through riser 4 is discharged into one or more cyclonic separation zones about the riser discharge and represented by cyclone separators 14 and 15. There may be a plurality of cyclone separator combinations comprising first and second cyclonic separation means attached to the riser discharge for separating catalyst particles from hydrocarbon vapors. Separated hydrocarbon vapors are passed from separators 14 and 15 to a plenum chamber 16 for withdrawal therefrom by conduit 18. Hydrocarbon vapors and gasiform material separated by stripping gas as defined below are passed by conduit 18 to separation equipment 19. From separation equipment 19 passes liquid product through line 20 rich in BTX and having a substantially lower mid-boiling point than the heavy reformate feed introduced via line 2 or injection points 10 and 12. Through line 21 passes gaseous product rich in light olefins and isoparaffins which may be useful for alkylation plant feed or as a chemical feedstock.

Catalyst separated from hydrocarbon vapors in the cyclonic separation means is passed by diplegs represented by dipleg 22 to a dense fluid bed of separated catalyst 23 retained about an upper portion of riser 4. Catalyst bed 23 maintained in a dense fluid bed condition by rising gasiform material passes downwardly through a stripping zone 24 immediately therebelow and counter-current to rising stripping gas introduced to a lower portion thereof by conduit 26. Baffles 28 are provided in the stripping zone to improve the stripping operation.

The stripping gas with desorbed hydrocarbons passes through one or more cyclonic separation means 32 wherein entrained catalyst fines are separated and returned to the catalyst bed 23 by dipleg 34. On the other hand, riser 4 may terminate with the commonly known bird cage discharge device or an open end "T" connection may be fastened thereto which is not directly connected to cyclonic separation means. The cyclonic separation means may be spaced apart from the riser discharge so that an initial catalyst separation is effected by a change in velocity and the vapors less encumbered with catalyst fines then passing through one or more cyclonic separation means. In any of these arrangements, gasiform materials comprising stripping gas is passed from the cyclonic separation means represented by separator 32 to a plenum chamber 16 for removal with hydrocarbon products of the operation by conduit 18. Gasiform material comprising hydrocarbon vapors is passed by conduit 18 to a product separation equipment 19.

Hot stripped catalyst at an elevated temperature is withdrawn from a lower portion of the stripping zone by conduit 36 for transfer to a dense fluid bed of catalyst in a catalyst regeneration zone, or returned to a previous operation from which it was cascaded as heretofore mentioned. The catalyst may also subsequently be cascaded to a following conversion step and/or cascaded to the inlet of riser 4 for admixture with catalyst from conduit 6. Flow control valve 38 is provided in transfer conduit 36.

In addition, the process can include any combination of the following options:

1. Addition of a reformate processing riser system as a satellite on an existing short contact time FCC unit, with common fractionation system, and with or without common separation/regeneration system; a particularly preferred aspect of this satellite system is that a slip stream of spent catalyst can be taken from reactor to the existing regenerator; an FCC could operate in blocked out operation with one or more chemical-type operations.

2. Provisions for recycle of unconverted reactant or higher boiling alkylaromatics to the riser is desired.

3. Provisions for recycle cascade of partially coked catalysts to regulate cat/oil ratio or catalyst activity/-selectivity.

4. Provisions for multiple injection of reactant(s) along the riser(s).

5. Provisions for fluidized dense bed processing in addition to riser reaction, i.e., provision for longer contact time exposure of reactants, if desired.

6. Inclusion of multiple, separate risers for upgrading of reactants, recycled products or product-reactant combinations, wherein temperature, cat/oil ratio, residence time, catalyst activity/selectivity/type can be varied to meet the requirements of a particular fraction (or product specification).

7. Regeneration system where a particle density gradient (between two catalyst types of different density) is established in a regenerator, and regenerated catalyst from each of the two (density) zones is returned separately to various positions in risers.

8. Provisions for common or separate cyclone (catalyst/oil separation) system.

9. Provisions for common or separate regeneration system.

10. Provisions for using different catalysts in the separate riser systems, or in separate stages of a single riser if desired.

11. Provisions for reactivation of catalyst between regenerator and reactor.

12. Provisions for introduction of promoters such as $H_2O$, $CO_2$, HCl, etc. between regenerator and reactor.

13. Source of heat to get catalyst/reactant temperature to the desired mix temperature can be any one or any combination of the following:

- from feed preheat
- from feed/effluent heat exchange systems
- from regenerated catalyst from this process
- from regenerated catalyst from a large, existing fuels FCC if there is a satellite chemicals reactor
- from burning of torch oil, petroleum coke or other coke in the regenerator with heat transferred to the reactor via the circulating catalyst
- where very low coke level catalyst from this process is cascaded to another reaction system in series with the first, such as gas oil cracking, where additional coke is laid down (thus taking advantage of the residual catalyst activity), and then, the more highly coked catalyst is sent to the regenerator.

DESCRIPTION OF SPECIFIC EMBODIMENTS

As stated above, the catalyst useful in this invention is a porous acid-active zeolite having an FAI of at least about 18. Such zeolites include, among others, acid-active forms of zeolites X, Y, ZSM-5, ZSM-11, ZSM-12, ZSM-35, ZSM-38 and dealuminized mordenite.

Zeolite X is described in U.S. Pat. No. 2,882,244, the disclosure of which is incorporated herein by reference. Zeolite Y is described in U.S. Pat. No. 3,130,007, the disclosure of which is incorporated herein by reference. Dealuminized mordenite for use in the present invention may be one prepared by the method of U.S. Pat. No. 3,551,353, the disclosure of which is incorporated herein by reference. Zeolite ZSM-5 is described in U.S. Pat. No. 3,702,886, the disclosure of which is incorporated herein by reference. Zeolite ZSM-11 is described in U.S. Pat. No. 3,709,979, the disclosure of which is incorporated herein by reference. Zeolite ZSM-12 is described in U.S. Pat. No. 3,832,449, the disclosure of which is incorporated herein by reference.

ZSM-35 is more particularly described in U.S. Application Ser. No. 528,061, filed Nov. 29, 1974. This zeolite can be indentified, in terms of mole ratios of oxides and in the anhydrous state, as follows:

$$(0.3\text{–}2.5)R_2O : (0\text{–}0.8)M_2O : Al_2O_3 : x\ SiO_2$$

wherein $x$ is greater than 8, $R$ is an organic nitrogen-containing cation derived from ethylenediamine or pyrrolidine and $M$ is an alkali metal cation, and is characterized by a specified X-ray powder diffraction pattern.

In a preferred synthesized form the zeolite has a formula, in terms of mole ratios of oxides and in the anhydrous state, as follows:

$$(0.4\text{–}2.5)R_2O : (0\text{–}0.6)M_2O : Al_2O_3 : ySiO_2$$

wherein $R$ is an organic nitrogen-containing cation derived from ethylenediamine or pyrrolidine, $M$ is an alkali metal, especially sodium, and $y$ is from greater than 8 to about 50.

The synthetic ZSM-35 zeolite possesses a definite distinguishing crystalline structure whose X-ray diffraction pattern shows substantially the significant lines set forth in Table I. It is observed that this X-ray diffraction pattern (with respect to significant lines) is similar to that of natural ferrierite with a notable exception being than natural ferrierite patterns exhibit a significant line at 11.33A. Close examination of some individual samples of ZSM-35 may show a very weak line at 11.3 – 11.5A. This very weak line, however, is determined not to be a significant line for ZSM-35.

TABLE I

| d(A) | I/Io |
|---|---|
| 9.6 ± 0.20 | Very Strong – Very, Very Strong |
| 7.10 ± 0.15 | Medium |
| 6.98 ± 0.14 | Medium |
| 6.64 ± 0.14 | Medium |
| 5.78 ± 0.12 | Weak |
| 5.68 ± 0.12 | Weak |
| 4.97 ± 0.10 | Weak |
| 4.58 ± 0.09 | Weak |
| 3.99 ± 0.08 | Strong |
| 3.94 ± 0.08 | Medium – Strong |
| 3.85 ± 0.08 | Medium |
| 3.78 ± 0.08 | Strong |
| 3.74 ± 0.08 | Weak |
| 3.66 ± –.07 | Medium |
| 3.54 ± 0.07 | Very Strong |
| 3.48 ± 0.07 | Very Strong |
| 3.39 ± 0.07 | Weak |
| 3.32 ± 0.07 | Weak – Medium |
| 3.14 ± 0.06 | Weak Medium |
| 2.90 ± 0.06 | Weak |
| 2.85 ± 0.06 | Weak |
| 2.71 ± 0.05 | Weak |

TABLE I-continued

| d(A) | I/Io |
|---|---|
| 2.65 ± 0.05 | Weak |
| 2.62 ± 0.05 | Weak |
| 2.58 ± 0.05 | Weak |
| 2.54 ± 0.05 | Weak |
| 2.48 ± 0.05 | Weak |

Zeolite ZSM-35 can be suitably prepared by preparing a solution containing sources of an alkali metal oxide, preferably sodium oxide, an organic nitrogen-containing oxide, an oxide of aluminum, an oxide of silicon and water and having a composition, in terms of mole ratios of oxides, falling within the following ranges:

| | Broad | Preferred |
|---|---|---|
| $R^+/(R^+ + M^+)$ | 0.2 - 1.0 | 0.3 - 0.9 |
| $OH^-/SiO_2$ | 0.05 - 0.5 | 0.07 - 0.49 |
| $H_2O/OH^-$ | 41 - 500 | 100 - 250 |
| $SiO_2/Al_2O_3$ | 8.8 - 200 | 12 - 60 |

wherein $R$ is an organic nitrogen-containing cation derived from pyrrolidine or ethylenediamine and $M$ is an alkali metal ion, and maintaining the mixture until crystals of the zeolite are formed. The quantity of $OH^{31}$ is calculated only from the inorganic sources of alkali without any organic base contribution. Thereafter, the crystals are separated from the liquid and recovered. Typical reaction conditions consist of heating the foregoing reaction mixture to a temperature of from about 90° F to about 400° F for a period of time of from about 6 hours to about 100 days. A more preferred temperature range is from about 150° F to about 400° F with the amount of time at a temperature in such range being from about 6 hours to about 80 days.

The digestion of the gel particles is carried out until crystals form. The solid product is separated from the reaction medium, as by cooling the whole to room temperature, filtering and water washing. The crystalline product is dried, e.g. at 230° F, for from about 8 to 24 hours.

Zeolite ZSM-38 is more particularly described in U.S. Application Ser. No. 560,412, filed Mar. 20, 1975. This zeolite can be identified, in terms of mole ratios of oxides and in the anhydrous state, as follows:

$$(0.3\text{–}2.5)R_2O : (0\text{–}0.8)M_2O : Al_2O_3 : xSiO_2$$

wherein $x$ is greater than 8, $R$ is an organic nitrogen-containing cation derived from a 2-(hydroxyalkyl) trialkylammonium compound and $M$ is an alkali metal cation, and is characterized by a specified X-ray powder diffraction pattern.

In a preferred synthesized form, the zeolite has a formula, in terms of mole ratios of oxides and in the anhydrous state, as follows:

$$(0.4\text{–}2.5)R_2O : (0\text{–}0.6)M_2O : Al_2O_3 : ySiO_2$$

wherein $R$ is an organic nitrogen-containing cation derived from a 2-(hydroxyalkyl) trialkylammonium compound, wherein alkyl is methyl, ethyl or a combination thereof, $M$ is an alkali metal, especially sodium, and $y$ is from greater than 8 to about 50.

The synthetic ZSM-38 zeolite possesses a definite distinguishing crystalline structure whose X-ray diffraction pattern shows substantially the significant lines set forth in Table II. It is observed that this X-ray diffraction pattern (significant lines) is similar to that of natural ferrierite with a notable exception being that natural ferrierite patterns exhibit a significant line at 11.33A.

TABLE II

| d(A) | I/Io |
|---|---|
| 9.8 ± 0.20 | Strong |
| 9.1 ± 0.19 | Medium |
| 8.0 ± 0.16 | Weak |
| 7.1 ± 0.14 | Medium |
| 6.7 ± 0.14 | Medium |
| 6.0 ± 0.12 | Weak |
| 4.37 ± 0.09 | Weak |
| 4.23 ± 0.09 | Weak |
| 4.01 ± 0.08 | Very Strong |
| 3.81 ± 0.08 | Very Strong |
| 3.69 ± 0.07 | Medium |
| 3.57 ± 0.07 | Very Strong |
| 3.51 ± 0.07 | Very Strong |
| 3.34 ± 0.07 | Medium |
| 3.17 ± 0.06 | Strong |
| 3.08 ± 0.06 | Medium |
| 3.00 ± 0.06 | Weak |
| 2.92 ± 0.06 | Medium |
| 2.73 ± 0.06 | Weak |
| 2.66 ± 0.05 | Weak |
| 2.60 ± 0.05 | Weak |
| 2.49 ± 0.05 | Weak |

A further characteristic of both ZSM-35 and ZSM-38 is their sorptive capacity providing them to have increased capacity for 2-methylpentane (with respect to n-hexane sorption by the ratio n-hexane/2-methylpentane) when compared with a hydrogen form of natural ferrierite resulting from calcination of an ammonium exchanged form. The characteristic sorption ratio n-hexane/2-methylpentane for both ZSM-35 and ZSM-38 (after calcination at 600° C) is less than 10, whereas that ratio for the natural ferrierite is substantially greater than 10, for example, as high as 34 or higher.

Zeolite ZSM-38 can be suitably prepared by preparing a solution containing sources of an alkali metal oxide, preferably sodium oxide, an organic nitrogen-containing oxide, an oxide of aluminum, an oxide of silicon and water and having a composition, in terms of mole ratios of oxides, falling within the following ranges:

| | Broad | Preferred |
|---|---|---|
| $R^+/(R^+ + M^+)$ | 0.2 - 1.0 | 0.3 - 0.9 |
| $OH^-/SiO_2$ | 0.05 - 0.5 | 0.07 - 0.49 |
| $H_2O/OH^-$ | 41 - 500 | 100 - 250 |
| $SiO_2/Al_2O_3$ | 8.8 - 200 | 12 - 60 |

wherein $R$ is an organic nitrogen-containing cation derived from a 2-(hydroxyalkyl) trialkylammonium compound and $M$ is an alkali metal ion, and maintaining the mixture until crystals of the zeolite are formed. The quantity of $OH^-$ is calculated only from the inorganic sources of alkali without any organic base contribution. Thereafter, the crystals are separated from the liquid and recovered. Typical reaction conditions consist of heating the foregoing reaction mixture to a temperature of from about 90° F to about 400° F for a period of time of from about 6 hours to about 100 days. A more preferred temperature range is from about 150° F to about 400° F with the amount of time at a temperature in such range being from about 6 hours to about 80 days.

The digestion of the gel particles is carried out until crystals form. The solid product is separated from the reaction medium, as by cooling the whole to room temperature, filtering and water washing. The crystalline product is thereafter dried, e.g. at 230° F for from about 8 to 24 hours.

The specific zeolites above described, when prepared in the presence of organic cations, are catalytically inactive, possibly because the intracrystalline free space is occupied by organic cations from the forming solution. They may be activated by heating, for example, in an inert atmosphere at 1000° F for 1 hour, followed by base exchange with ammonium salts and by calcination at 1000° F in air. The presence of organic cations in the forming solution may not be absolutely essential to the formation of the type zeolite for use herein; however, the presence of these cations does appear to favor the formation of said zeolite. More generally, it is desirable to activate the catalyst for use herein by base exchange with ammonium salts followed by calcination in air at about 1000° F for from about 15 minutes to about 24 hours.

Natural zeolites may sometimes be converted to this type zeolite catalyst by various activation procedures and other treatments such as base exchange, steaming, alumina extraction and calcination, in combinations. Natural minerals which may be so treated include ferrierite, brewsterite, stilbite, dachiardite, epistilbite, heulandite and clinoptilolite. The preferred crystalline aluminosilicates for use herein are X, Y, dealuminized mordenite, ZSM-5, ZSM-11, ZSM-12, ZSM-35 and ZSM-38, with ZSM-5 particularly preferred.

The catalysts for use in this invention may be in the hydrogen form or they may be based exchanged or impregnated to contain ammonium or a metal cation complement. It is desirable to calcine the catalyst after base exchange. The metal cations that may be present include any of the cations of the metals of Groups I through VIII of the Periodic Table, especially rare earth metals. However, in the case of Group IA metals, the cation content should in no case be so large as to effectively inactivate the catalyst.

"Fluid activity index" (FAI) is defined as the conversion obtained to provide a 356° F 90% ASTM gasoline product processing a Light East Texas Gas Oil (LETGO) at a 2 catalyst/oil ratio, 850° F, 6 WHSV for 5 minutes on stream time. Conversion is defined as 100-cycle oil product.

As in the case of many catalysts, it is desirable to incorporate the catalyst for use herein with another material resistant to the temperature and other conditions employed in the present process. Such matrix materials include active and inactive materials and synthetic or naturally occurring zeolites as well as inorganic materials such as clays, silica and/or metal oxides. The latter may be either naturally occurring or in the form of gelatinous precipitates, sols or gels including mixtures of silica and metal oxides. Inactive materials suitably serve as diluents to control the amount of conversion in a given process so that products can be obtained economically and orderly without employing other means for controlling the rate of reaction. Frequently, zeolite materials have been incorporated into naturally occurring clays, e.g. bentonite and kaolin. These materials, i.e. clays, oxides, etc., function, in part, as binders for the catalyst. It is desirable to provide a catalyst having good crush strength, because in the process of this invention the catalyst is subjected to rough handling, which may tend to break the catalyst down into powder-like materials which cause problems in processing.

Naturally occurring clays which can be composited with the zeolites for use herein include the montmorillonite and kaolin families, which include the sub-bentonites and the kaolins commonly known as Dixie, McNamee, Georgia and Florida clays or others in which the main mineral constituent is halloysite, kaolinite, dickite, nacrite or anauxite. Such clays can be used in the raw state as originally mined or initally subjected to calcination, acid treatment or chemical modification.

In addition to the foregoing materials, the zeolites for use herein can be composited with one or more porous matrix materials such as silica-alumina, silica-magnesia, silica-zirconia, silica-thoria, silica-beryllia, silica-titania, titania-zirconia as well as ternary compositions such as silica-alumina-thoria, silica-alumina-zirconia, silica-alumina-magnesia and silica-magnesia-zirconia. The matrix can be in the form of a cogel. A mixture of these components, one with the other and/or with a clay, could also be used. The relative proportions of finely divided porous zeolite having an FAI of at least 18 for use herein and inorganic oxide gel matrix and/or clay vary widely with the crystalline aluminosilicate content ranging from about 1 to about 90 percent by weight and more usually in the range of about 2 to about 50 percent by weight of the composite.

Reaction conditions under which the invention is conducted may vary with different charge stock compositions within the definition of heavy reformate and with differences in design factors of the equipment used in the process. Although the reaction temperature in the present process at the reactor system or riser inlet may be maintained at between about 800° F and about 1200° F, the preferred temperature is from about 900° F to about 1150° F. The broadest applicable reaction pressure useful in the process is from about 2 psig to about 100 psig, with preferred pressure being within the range of from about 15 psig to about 45 psig. The catalyst/oil weight ratio may be maintained within the broad range of from about 0.5 to about 40, with a preferred catalyst/oil weight ratio of between about 4 and about 25. Catalyst residence time and heavy reformate residence time are also critical factors in this process and may be maintained within the ranges of from about 0.1 second to about 20 seconds and from about 0.1 second to about 20 seconds, respectively, with preferred ranges of from about 2 seconds to about 15 seconds and from about 2 seconds to about 15 seconds, respectively. The preferred slip ratio, hereinabove defined, is within the range of from about 1 to about 1.6.

Embodiments of the processing of the present invention are illustrated by the specific examples which follow. It is to be understood that these specific embodiments are illustrative and do not limit the scope of the invention as defined above. Examples 1-5 illustrate preparation of catalyst materials useful in the present process.

EXAMPLE 1

(Catalyst Preparation)

This was a silica-clay-$ZrO_2$ matrix catalyst having a composition 60 weight percent silica and 40 weight percent clay to which was added sufficient sodium zirconium silicate to contribute 2 weight percent $ZrO_2$.

The catalytic composition was prepared by slurrying 4.97 pounds of Georgia Kaolin clay (85.8 weight percent solids on dry basis) into 95.55 pounds of water. To this slurry was then added 21.975 pounds of Q-Brand sodium silicate (28.9 weight percent $SiO_2$, 8.9 weight percent $Na_2O$, 62.2 weight percent $H_2O$) which was heated to 120° F. The slurry was then heated to 120° F and acidified with 500 cc concentrated $H_2SO_4$ followed with heating to and holding at 140° F for 2 hours. During all of the processing the slurry was mixed vigorously in a batch tank with continuous recirculation to insure good dispersion. To the aged heat treated slurry was then added 276 grams of a sodium zirconium silicate dispersed in 3 liters of water containing 180 cc of concentrated $H_2SO_4$. This amount of sodium zirconium silicate constituted an addition of 2 weight percent $ZrO_2$ to the matrix. The slurry was further acidified to 4.5 pH by the addition of 169.6 cc of concentrated $H_2SO_4$ and allowed to stand overnight while being mixed slowly.

To the aged acidified slurry was added 34.8 cc of 50 percent KOH solution to adjust the pH to 4.5 prior to the addition of the zeolites. The zeolite components were made up of 125 grams of REY (rare earth exchanged Y zeolites to 2.9 weight percent residual sodium commercially calcined to about 1000°–1200° F) along with 699 grams of hydrogen-exchanged mordenite dispersed in 220 cc water with 7.5 grams of Marasperse "N", a dispersing agent. These zeolitic components were first dispersed in a high shear mixer followed by three passes in a colloid mill before addition to the clay silicate slurry. The REY component constituted 2 weight percent of the final composition and the mordenite constituted 10 weight percent of the final composition.

The final slurry containing the zeolite components was sprayed dried with an inlet air temperature of 865°–895° F and an exit air temperature of 325° F.

The spray dried product was slurried in water, then base exchanged with a 5 weight percent $(NH_4)_2SO_4$ solution at room temperature. The exchange solution consisted of 15 gallons of solution charged over about 5 pounds of catalyst during a 5 hour period. The exchanged catalyst was then water washed free of sulfate ion; contacted with 1% $RECl_3.6H_2O$ solution; filtered; dried at 340° F; then steamed for 4 hours at 1400° F with 100% steam at atmospheric pressure.

The final steamed product containing 2 weight percent REY and 10 weight percent mordenite had a residual sodium content of 0.03 weight percent and a surface area of 205 m²/gram. The FAI of this catalyst composition proved to be 38.6.

EXAMPLE 2

(Catalyst Preparation)

This catalyst, a silica-clay-$ZrO_2$ matrix containing 10 weight percent aluminum defficient mordenite was prepared essentially in the same manner as described in Example 1. The aluminum defficient mordenite was prepared by treating 4.5 pounds of hydrogen-exchanged mordenite with a 2.07 weight percent HCl solution, using 7.5 grams solution/gram of mordenite, for 2 hours at 146° F. This process was repeated twice more at 165° F with decantation between each contact. The final contact was followed with water washing free of chloride ion, drying at 340° F, calcining for 10 hours at 1000° F and steam treating for 16 hours at 1000° F with 100% steam. The steamed material was then retreated with HCl as described above followed by water washing, drying and calcining. The silica/alumina molar ratio of the aluminum defficient mordenite was 40/1.

The catalyst of this example as described above was used in both calcined (10 hours at 1000° F) and steamed form (4 hours at 1400° F). The surface area of the calcined form was 282 m²/gram and the steamed form was 198 m²/gram. The FAI of the calcined form was 44.6. The FAI of the steamed form was 19.2.

EXAMPLE 3

(Catalyst Preparation)

This catalyst, a silica-clay-$ZrO_2$ matrix catalyst, was prepared essentially as described in Example 1, incorporating sufficient amount of HZSM-5 to constitute 10% HZSM-5 in final composition. The HZSM-5 used in this catalyst was prepared by precalcining, 3 hours at 1000° F in $N_2$, a sodium nitrogen ZSM-5 then exchanging with $NH_4Cl$ solution, followed by water washing chloride free and incorporating into the matrix. The silica/alumina molar ratio of the HZSM-5 component was 70/1.

The final fluid catalyst was used in the calcined form (10 hours at 1000° F). It proved to have an FAI of 42.6.

EXAMPLE 4

(Catalyst Preparation)

This fluid catalyst was prepared to contain 20 weight percent HZSM-5 in a silica-alumina (13 weight percent $Al_2O_3$) matrix.

The particular ZSM-5 used in this composition was prepared by interacting the following solutions:

Silicate Solution 90.9 pounds of Q-Brand sodium silicate (28.9 weight percent $SiO_2$, 8.9 weight percent $Na_2O$, 62.2 weight percent $H_2O$)
52.6 pounds of $H_2O$ (26.3 pounds of ice)
0.266 pounds of Daxad dispersing agent
Specific Gravity 1.226 at 60.

Acid Solution 54 pounds of water (27 pounds of ice)
6.3 pounds of $Al_2(SO_4)_3.XH_2O$
4.06 pounds of NaCl
6.0 pounds of $H_2SO_4$
Specific Gravity 1.147 at 60
12.95 pounds of NaCl and 2.6 pounds of water added to autoclave.

These solutions were nozzle mixed together at a rotometer indication of 83% silicate and 44% acid solution and charged directly to a 30 gallon autoclave. The mixture was then whipped for 1 hour at 90 RPM. The autoclave was tested for leaks. Then addition thereto was made of the following organics:

10.9 pounds of n-propylamine
5.28 pounds of n-propylbromide
10.1 pounds of methylethylketone The autoclave was then sealed and heated to 220° F (no agitation) and held at that temperature for 6 hours. After this initial reaction period the agitation was started and reactants heated to 210°–230° F and held at 210°–230° F for 7 days. At the end of this period the product was 85% crystalline ZSM-5. The reactants were then heated to 300° F to flash off the unreacted organics and cooled to room temperature. This product slurry was subsequently used as the source of ZSM-5 in the preparation of the silica-alumina matrix catalyst containing 20 weight percent ZSM-5.

In preparing the catalyst composite, the following solutions and procedure were used. Two hundred sixty two pounds of water was charged to a 30-gallon mixing drum. To this was then added 52.3 pounds Q-Brand (28.9 weight percent $SiO_2$, 8.9 weight percent $Na_2O$, 62.2 weight percent $H_2O$). This solution was acidified with 1253 cc $H_2SO_4$ (95.9 weight percent) to a pH of 10.0 and allowed to react for 45 minutes. To this was then added 6048 grams $Al_2(SO_4)_3.XH_2O$ in 52.9 pounds of $H_2O$, introducing 13 weight percent $Al_2O_3$ and acidified silicate solution. The pH was finally adjusted to 4.5 with the addition of 50% NaOH solution. To the 4.5 pH slurry was then added 1983 grams of ZSM-5, prepared as described above, dispersed in 6000 cc of water.

The composite was spray dried in a countercurrent spray dryer, then exchanged with 20 gallons of 5% $(NH_4)_2SO_4$ solution followed by water washing free of sulfate ion.

The final product was calcined for 3 hours at 1200° F with air in a fluidized bed. The FAI of this catalyst proved to be 51.98.

EXAMPLE 5

(Catalyst Preparation)

This catalyst was a silica-clay-alumina-zirconia matrix catalyst containing 15 weight percent added REY. The catalytic composite was prepared by first dispersing 774 pounds (dry basis) of Georgia Kaolin clay in 19,810 pounds (2390 gallons) of deionized water and thoroughly mixing. To this was added, over 30 minutes, 3861 pounds (334 gallons) Q-Brand sodium silicate (28.9 weight percent $SiO_2$, 8.9 weight percent $Na_2O$, 62.2 weight percent $H_2O$). It was then heated to 120° F. Aqueous 35 weight percent $H_2SO_4$ was then added to adjust the pH to 9.8 and it was aged at this temperature to produce a fluid catalyst having a pore volume of 0.65 to 0.71 cc/gram (approximately 1 hour). An aluminum sulfate solution was then added to contribute 12 pounds of $Al_2O_3$ to the batch. In addition a slurry of 84 pounds sodium zirconium silicate (45 weight percent $ZrO_2$), dispersed in 6.7 gallons of 66° Baume sulfuric acid and 95 gallons of deionized water, was added over a 45 minute period. While under agitation, additional acid (35% $H_2SO_4$) or 50% NaOH was added to adjust pH to 4.5–4.6.

To the acidified silica-clay-$Al_2O_3$-$ZrO_2$ matrix slurry was added the rare earth Y as a slurry of 342 pounds (dry basis) of rare earth Y dispersed in 125 gallons of water. This slurry was pumped into the tank containing the matrix slurry and mixed extensively to insure uniformity.

The resulting slurry was dewatered on a belt filter to about 10–15 weight percent solids prior to spray drying.

The spray dried product was ion-exchange with ammonium sulfate solution to reduce the residual sodium to 0.2 weight percent. Subsequently, the exchanged spray dried product was contacted with $RECl_3.6H_2O$ solution to deposit approximately 3 weight percent additional $(RE)_2O_3$ in the catalyst. The treated catalyst was then flash dried to a solids content of about 85% at 1800° F.

The composition of the fluid catalyst which had an FAI of 67.5 was as follows:

$Na_2O$: <0.2 weight percent
$SO_4$: ≦0.5 weight percent
$(RE)_2O_3$: 4.9–5.3 weight percent
$Al_2O_3$: 17–19 weight percent
Fe: ≦0.15 weight percent
$ZrO_2$: 1.6–1.9 weight percent

EXAMPLES 6–9

Experiments were conducted in a 30-foot bench scale FCC riser unit to demonstrate the present process. A heavy reformate feedstock oil having characteristics listed in Table IV hereinafter presented was processed in accordance herewith in separate runs at various conditions and over various catalysts. In general, the feedstock was pumped to the inlet of the riser, preheated to 500° F and admitted to the riser inlet, where hot catalyst was also admitted. Effluent obtained from the unit was then passed through a stripping chamber where gaseous effluent was separated from spent catalyst. The gaseous effluent was then cooled and liquid product was collected. The liquid product was then separated by fractionation and analyzed. Variables which were measured or calculated and which appear in Table III or IV hereinafter included reactor inlet temperature, oil inlet temperature, catalyst inlet temperature, mix temperature, catalyst/oil weight ratio, catalyst residence time, oil residence time, riser inlet pressure, oil partial pressure, moles of product/mole of feedstock oil, amount of carbon on spent catalyst and product composition.

TABLE III

| | PROCESSING HEAVY REFORMATE | | | |
|---|---|---|---|---|
| Example | 6 | 7 | 8 | 9 |
| Reaction Conditions | | | | |
| Reactor Inlet Temperature, ° F | 900 | 1100 | 1100 | 1100 |
| Oil Inlet Temperature, ° F | 500 | 500 | 500 | 500 |
| Catalyst Inlet Temperature, ° F | 1039 | 1157 | 1157 | 1157 |
| $T_{mix}$, ° F | 902 | 1086 | 1069 | 1076 |
| Catalyst/Oil (wet/wt) Ratio | 8.1 | 22.86 | 17.73 | 19.63 |
| Catalyst Residence Time, sec. | 3.77 | 9.94 | 9.46 | 13.65 |
| Oil Residence Time, sec. | 3.12 | 7.89 | 7.45 | 10.75 |
| Riser Inlet Pressure, psig | 30 | 30 | 30 | 30 |
| Oil Partial Pressure, psia | 35.9 | 20.4 | 19.4 | 26.6 |
| Moles of Product/Mole of Feed (ex coke) | 1.142 | 1.466 | 1.424 | 1.217 |
| Carbon, Spent Catalyst, % Wt. | .207 | .052 | .028 | .390 |
| Slip Ratio | 1.21 | 1.26 | 1.27 | 1.27 |
| Catalyst of | Example 5 | Example 2 | Example 3 | Example 5 |
| Mass Balance, Wt.% | | | | |
| $C_6$+ Liquid | 91.87 | 85.08 | 88.99 | 75.84 |
| $C_5$'s | 1.24 | 1.22 | .52 | 1.44 |
| $C_4$−Gas | 5.04 | 12.41 | 9.96 | 14.46 |
| Coke | 1.85 | 1.29 | .54 | 8.26 |
| Recovery | 94.5 | 85.38 | 90.01 | 92.53 |

TABLE IV

| PROCESSING HEAVY REFORMATE | | | | | |
|---|---|---|---|---|---|
| Example | | 6 | 7 | 8 | 9 |
| Total Product Breakdown, Wt.%, NLB | Feed[a] | | | | |
| Coke | .00 | 1.85 | 1.29 | .54 | 8.26 |
| $C_5^-$ | .00 | 6.28 | 13.63 | 10.48 | 15.90 |
| $C_6^-$ P,N | .00 | .67 | .09 | .09 | .23 |
| $C_7^-$ P,N | .01 | .16 | .02 | .04 | .01 |
| $C_8^-$ P,N | 1.68 | 1.04 | .56 | .83 | .10 |
| $C_9^-$ P,N | 4.06 | 1.47 | 1.20 | 1.89 | .03 |
| $C_{10}^-$ P,N | 1.19 | .15 | .31 | 1.28 | .01 |
| | 6.94 | 3.49 | 2.18 | 4.13 | .38 |
| Benzene | .00 | 1.14 | 3.11 | 4.19 | 4.88 |
| Toluene | 2.30 | 10.27 | 15.11 | 12.20 | 24.63 |
| Ethylbenzene | 5.63 | 4.95 | 2.64 | 2.07 | 1.59 |
| p-Xylene | 6.84 | 7.24 | 7.04 | 6.45 | 5.93 |
| m-Xylene | 14.82 | 16.14 | 18.02 | 15.73 | 14.90 |
| o-Xylene | 10.34 | 8.57 | 8.28 | 11.08 | 6.36 |
| Other $C_8$ Aromatics | Trace | Trace | Trace | Trace | Trace |
| $C_9^-$ Aromatics | 37.80 | 27.24 | 21.48 | 22.87 | 11.51 |
| $C_{10}^-$ Aromatics | 10.38 | 9.97 | 4.12 | 6.53 | 1.57 |
| $C_{11}^-$ Aromatics | 2.90 | 1.71 | .60 | 1.32 | .17 |
| Other Higher Aromatics | 2.04 | 1.14 | 2.51 | 2.41 | 3.95 |

| Xylene Isomer Breakdown, Wt.% vs Equilibrium | Obs | Obs | Eq | Obs | Eq | Obs | Eq | Obs | Eq |
|---|---|---|---|---|---|---|---|---|---|
| para-Xylene | 21.4 | 22.7 | 23.2 | 21.1 | 22.8 | 19.4 | 22.8 | 21.8 | 22.8 |
| meta-Xylene | 46.3 | 50.5 | 51.7 | 54.0 | 50.5 | 47.3 | 50.5 | 54.8 | 50.5 |
| ortho-Xylene | 32.3 | 26.8 | 25.0 | 24.8 | 26.7 | 33.3 | 26.7 | 23.4 | 26.7 |

| $C_5^-$ Product, Normalized, Wt.% | | | | |
|---|---|---|---|---|
| $H_2$ | .0 | 1.7 | .9 | .8 |
| Methane | 1.8 | 4.6 | 3.7 | 18.5 |
| Ethylene | 9.3 | 30.3 | 39.6 | 13.3 |
| Ethane | 1.6 | 2.5 | 2.7 | 9.7 |
| Propylene | 14.1 | 14.5 | 27.8 | 5.2 |
| Propane | 14.9 | 15.3 | 4.6 | 21.7 |
| Butene | 6.6 | 6.8 | 11.0 | 2.8 |
| i-Butane | 19.7 | 11.7 | 2.9 | 12.2 |
| n-Butane | 7.4 | 3.7 | 1.9 | 6.9 |
| Pentene | 2.0 | 2.3 | 2.6 | .7 |
| i-Pentane | 20.1 | 6.0 | 1.9 | 5.6 |
| n-Pentane | 2.6 | .6 | 0.5 | 2.8 |
| | 100.1 | 100.0 | 100.1 | 100.2 |

[a]The feedstock was a 265° F+ reformate with a specific gravity of 0.8601 (72° F).
[b]P,N indicates paraffin and naphthene, respectively.

It is readily observed from the above specific examples that by the present process substantial conversion of $C_9$, $C_{10}$ and $C_{11}$ alkylaromatics to lower aromatics rich in BTX may be effected. Substantial conversion of ethylbenzene is also evident. Also, it is observed that mid-boiling point may be substantially reduced. Therefore, both fuels- and chemicals-oriented applications may derive from the present process, with considerable flexibility existing in the use of catalysts of different types and actual process engineering.

Having thus generally described the invention and provided specific examples in support of various operating concepts contemplated thereby, it is to be understood that no undue restrictions are to be imposed by reason thereof except as defined by the following claims.

What is claimed is:

1. A process for converting a heavy reformate feedstock having an initial boiling point between about 230° F and about 250° F and an end point between about 350° F and about 430° F into (a) liquid product rich in benzene, toluene and xylene and having a substantially lower midboiling point than said heavy reformate feedstock and (b) gaseous product rich in light olefins and isoparaffins which comprises contacting said feedstock in the absence of added hydrogen with a porous acid-active zeolite catalyst having a fluid activity index of at least about 18 and being selected from the group consisting of ZSM-11, ZSM-12, ZSM-35, ZSM-38 and dealuminized mordenite, in a fluidized catalyst system reactor with a reactor inlet temperature of between about 800° F and about 1200° F, a reactor pressure of between about 2 psig and about 100 psig, a catalyst/oil weight ratio of between about 0.5 and about 40, a catalyst residence time of between about 0.1 second and about 20 seconds, a feedstock residence time of between about 0.1 second and about 20 seconds and a slip ratio of between about 1 and about 2.

2. The process of claim 1 wherein said fluidized catalyst system is a riser/transport system.

3. The process of claim 1 wherein said reactor inlet temperature is from about 900° F to about 1150° F, said reactor pressure is from about 15 psig to about 45 psig, said catalyst/oil weight ratio is from about 4 to about 25, said catalyst residence time is from about 2 seconds to about 15 seconds, said feedstock residence time is from about 2 seconds to about 15 seconds and said slip ratio is from about 1 to about 1.6.

4. The process of claim 2 wherein said reactor inlet temperature is from about 900° F to about 1150° F, said reactor pressure is from about 15 psig to about 45 psig, said catalyst/oil weight ratio is from about 4 to about 25, said catalyst residence time is from about 2 seconds to about 15 seconds, said feedstock residence time is from about 2 seconds to about 15 seconds and said slip ratio is from about 1 to about 1.6.

5. A process for converting a heavy reformate feedstock having an initial boiling point between about 230° F and about 250° F and an end point between about 350° F and about 430° F into (a) liquid product rich in benzene, toluene and xylene and having a substantially lower midboiling point than said heavy reformate feedstock and (b) gaseous product rich in light olefins and isoparaffins which comprises contacting said feedstock in the absence of added hydrogen with a porous acid-active dealuminized mordenite zeolite catalyst having a fluid activity index of at least about 18 in a fluidized catalyst system reactor with a reactor inlet temperature of between about 800° F and about 1200° F, a reactor pressure of between about 2 psig and about 100 psig, a catalyst/oil weight ratio of between about 0.5 and about 40, a catalyst residence time of between about 0.1 second and about 20 seconds, a feedstock residence time of between about 0.1 second and about 20 seconds and a slip ratio of between about 1 and about 2.

6. The process of claim 5 wherein said fluidized catalyst system is a riser/transport system.

7. The process of claim 5 wherein said reactor inlet temperature is from about 900° F to about 1150° F, said reactor pressure is from about 15 psig to about 45 psig, said catalyst/oil weight ratio is from about 4 to about 25, said catalyst residence time is from about 2 seconds to about 15 seconds, said feedstock residence time is from about 2 seconds to about 15 seconds and said slip ratio is from about 1 to about 1.6.

8. The process of claim 6 wherein said reactor inlet temperature is from about 900° F to about 1150° F, said reactor pressure is from about 15 psig to about 45 psig, said catalyst/oil weight ratio is from about 4 to about 25, said catalyst residence time is from about 2 seconds to about 15 seconds, said feedstock residence time is from about 2 seconds to about 15 seconds and said slip ratio is from about 1 to about 1.6.

* * * * *

UNITED STATES PATENT AND TRADEMARK OFFICE

CERTIFICATE OF CORRECTION

PATENT NO. : 4,066,531

DATED : January 3, 1978

INVENTOR(S) : HARTLEY OWEN, PAUL B. VENUTO and EDWARD J. ROSINSKI

It is certified that error appears in the above-identified patent and that said Letters Patent are hereby corrected as shown below:

| | |
|---|---|
| Column 2, line 26: | "constrast" should read -- contrast --. |
| Column 6, Table I, line 21 thereof | "Weak Medium" should read -- Weak-Medium --. |
| Column 7, line 25: | "$OH^{31}$" should read -- $OH^-$ --. |

Signed and Sealed this

*Fifteenth* Day of *August 1978*

[SEAL]

*Attest:*

RUTH C. MASON
*Attesting Officer*

DONALD W. BANNER
*Commissioner of Patents and Trademarks*